US010118737B2

(12) United States Patent
Septien Rojas et al.

(10) Patent No.: US 10,118,737 B2
(45) Date of Patent: Nov. 6, 2018

(54) CHILD-RESISTANT RECLOSABLE BAGS

(71) Applicant: ILLINOIS TOOL WORKS INC., Glenview, IL (US)

(72) Inventors: Jose Manuel Septien Rojas, Scarborough (GB); Lars Wihlborg, Stratford, CT (US); Charles Greco, Bardonia, NY (US); Jeffry Mauro, Montgomery, NY (US); Glyn Russell, New City, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 393 days.

(21) Appl. No.: 13/973,312

(22) Filed: Aug. 22, 2013

(65) Prior Publication Data

US 2014/0161374 A1 Jun. 12, 2014

Related U.S. Application Data

(60) Provisional application No. 61/717,715, filed on Oct. 24, 2012.

(51) Int. Cl.
*B65D 33/00* (2006.01)
*B65D 33/25* (2006.01)

(52) U.S. Cl.
CPC ..... *B65D 33/2508* (2013.01); *B65D 33/2541* (2013.01); *B65D 2215/08* (2013.01)

(58) Field of Classification Search
CPC ..... B65D 33/2533; B65D 33/2591; B65D 33/2541; B65D 33/2508; B65D 33/25; B65D 33/255; B31B 19/90; B31B 2219/9019; A44B 19/34; A44B 19/16; A44B 19/267
USPC ..... 383/61.2, 61.3, 63, 64
See application file for complete search history.

(56) References Cited

U.S. PATENT DOCUMENTS

| | | | | |
|---|---|---|---|---|
| 4,528,224 | A * | 7/1985 | Ausnit | 428/35.5 |
| 4,673,383 | A | 6/1987 | Bentsen | |
| 4,817,188 | A * | 3/1989 | Van Erden | 383/63 |
| 4,878,763 | A * | 11/1989 | Ausnit | 383/65 |
| 5,017,021 | A * | 5/1991 | Simonsen et al. | 383/63 |
| 5,558,613 | A | 9/1996 | Tilman et al. | |
| 5,972,396 | A | 10/1999 | Jurgovan et al. | |
| 6,004,032 | A | 12/1999 | Kapperman et al. | |
| 6,389,651 | B2 * | 5/2002 | Johnson | 24/30.5 R |

(Continued)

FOREIGN PATENT DOCUMENTS

| | | |
|---|---|---|
| EP | 0985605 | 3/2000 |
| GB | 841 142 | 7/1960 |

(Continued)

OTHER PUBLICATIONS

Third Party Observation for applicant No. EP20130780453.

*Primary Examiner* — Peter Helvey
(74) *Attorney, Agent, or Firm* — McCarter & English, LLP

(57) ABSTRACT

The present disclosure relates to plastic or polymeric container with reclosable zippers which make the package child-resistant. In one typical embodiment, this is achieved by a zipper with a high internal opening force and a low external opening force, wherein three flanges are sealed to the bag walls, and one external flange is left unsealed. In order to encounter the low external opening force, the user must grab the unsealed external flange while applying an external opening force to the zipper.

12 Claims, 16 Drawing Sheets

(56) References Cited

U.S. PATENT DOCUMENTS

| | | | | |
|---|---|---|---|---|
| 6,550,965 | B2 * | 4/2003 | Shaffer et al. | 383/65 |
| 7,437,805 | B2 * | 10/2008 | Berich | 24/399 |
| 7,784,160 | B2 * | 8/2010 | Dais et al. | 24/585.12 |
| 7,886,412 | B2 * | 2/2011 | Dais et al. | 24/585.12 |
| 2002/0162200 | A1 | 11/2002 | Offa-Jones | |
| 2006/0111226 | A1 * | 5/2006 | Anzini et al. | 493/214 |
| 2008/0232722 | A1 * | 9/2008 | Pawloski et al. | 383/64 |
| 2010/0014786 | A1 * | 1/2010 | Pawloski et al. | 383/59 |
| 2010/0069211 | A1 | 3/2010 | Anzini et al. | |
| 2012/0045151 | A1 | 2/2012 | Eouzan | |

FOREIGN PATENT DOCUMENTS

| | | |
|---|---|---|
| PL | 64476 | 6/2009 |
| WO | 2009089019 | 7/2009 |

* cited by examiner

Child Proof Version

CHILD-RESISTANT RECLOSABLE BAGS

The present application claims priority under 35 U.S.C. 119(e) of provisional application Ser. No. 61/717,715, which was filed on Oct. 24, 2012, the disclosure of which is hereby incorporated by reference in its entirety.

BACKGROUND OF THE DISCLOSURE

Field of the Disclosure

The present disclosure relates to various embodiments of child-resistant reclosable packages or bags.

Description of the Prior Art

The prior art includes various child-resistant packages. Typically, these packages are designed to hold medicinal capsules, detergent capsules, or similar items which might be attractive, but harmful, to a child. The prior art has many examples of plastic lids, in order to be removed from the glass or plastic container, which must be squeezed or pushed in various ways which would not be apparent to a child or would be beyond the strength capabilities of the child. However, such containers are complicated to manufacture and add a considerable expense to the consumer product. Additionally, such containers may be heavy and bulky which adds to the costs of transportation. Furthermore, this weight and bulk adds to the recycling burden of these products.

OBJECTS AND SUMMARY OF THE DISCLOSURE

It is therefore an object of the present disclosure to provide child-resistant containers which maintain a high level of child resistance, while achieving reduced weight and costs with respect to manufacture, transportation and recycling.

These and other objects are obtained by a polymeric or plastic container with various zipper configurations, including zipper configurations with a high internal opening force and a low external opening force. Such configurations include zippers where only three flanges are sealed, so if the child attempts to open the bag by pulling the external part of the bag, the high opening force of the zipper is encountered. In order to encounter the low external opening force, the user must grab the unsealed external flange while attempting to open the bag.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
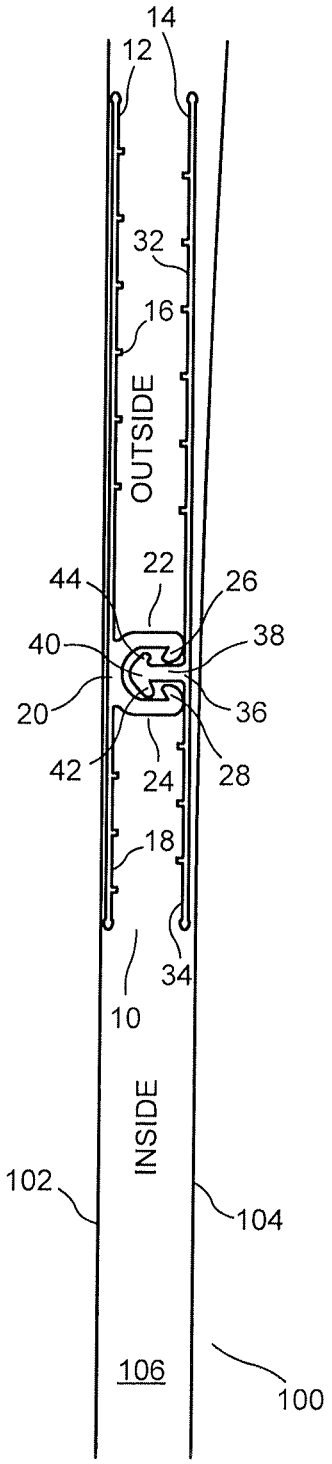
FIG. 1 is a cross-sectional view of a zipper as attached to the side walls of a plastic bag or container, thereby resulting in the first embodiment of the present disclosure.

Pursuant to this disclosure, one sees that FIGS. 1-6 relate to a first aspect of the present disclosure. In FIG. 1, zipper 10 includes first and second profiles 12, 14. First profile 12 includes a first exterior flange 16 and a first interior flange 18 as well as a female interlocking element 20 formed from first and second upwardly extending arms 22, 24 terminating in respective first and second detent hooks 26, 28. Likewise, second profile 14 includes second exterior flange 32 and a second interior flange 34 as well as a male interlocking element 36 formed from a post 38 and an arrowhead element 40. The interior wing 42 of arrowhead element 40 is more enlarged and protruding than the exterior wing 44 of arrowhead element 40. This causes the interior or product side or inside opening force to be greater than the exterior or consumer side or outside opening force.

First and second profiles 12, 14 are sealed or otherwise attached to the respective first and second sidewalls 102, 104 of bag 100. Of course, sidewalls 102, 104 are joined or integral so as to form a storage volume 106 in the interior of the bag 100. First exterior flange 16 and first interior flange 18 are sealed to first sidewall 102 so that the first exterior flange 16 is oriented toward the consumer side of the zipper and the first interior flange 18 is oriented toward the product side of the zipper. Likewise, second interior flange 34 is sealed to second sidewall 104 so that the second exterior flange 32 is oriented toward the consumer side of the zipper and the second interior flange 34 is oriented toward the product side of the zipper. However, second exterior flange 32 is free of sealing to the second sidewall 104. In this configuration, if a child grabbed the first and second sidewalls 102, 104 and tried to pull them apart in the conventional manner, the second sidewall 104 would transmit the opening forces to the interior side of the female and male interlocking elements 20, 36 thereby encountering the high interior opening force and making the zipper 10 very difficult, if not impossible, to open with regular manual forces. However, if one grabbed the second exterior flange 32 and the first sidewall 102, and pulled them apart, the lower exterior opening force will be encountered and the zipper will easily open.

Figure 2:
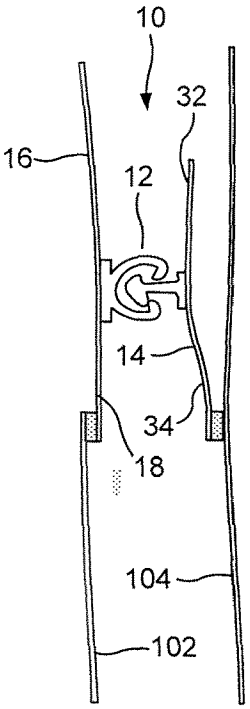
FIGS. 2-4 are cross-sectional views of variations of the embodiment of FIG. 1.
Figure 3:
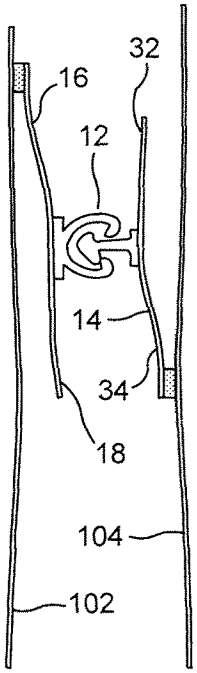
Figure 4:
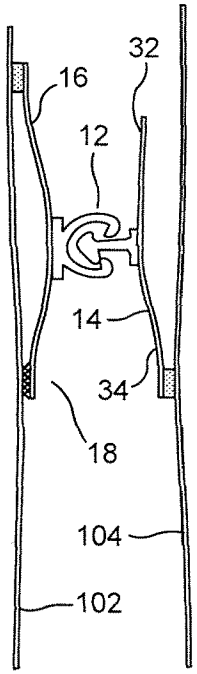

FIG. 2 illustrates a configuration with a shortened first sidewall 102, wherein the end of the first shortened sidewall 102 is sealed to the first interior flange 18. FIG. 3 illustrates a configuration wherein the first exterior flange 16 and the second interior flange 34 are sealed to the respective first and second sidewalls 102, 104 and the first interior flange 18 and the second exterior flange 32 are free of connection to the sidewalls 102, 104. FIG. 4 illustrates the tips of first interior and exterior flanges 16, 18 are sealed to first sidewall 102 as well as the tip of second interior flange 34 is sealed to second sidewall 104. The end of the second exterior flange 32 is free of connection to the second sidewall 104.

Figure 5:
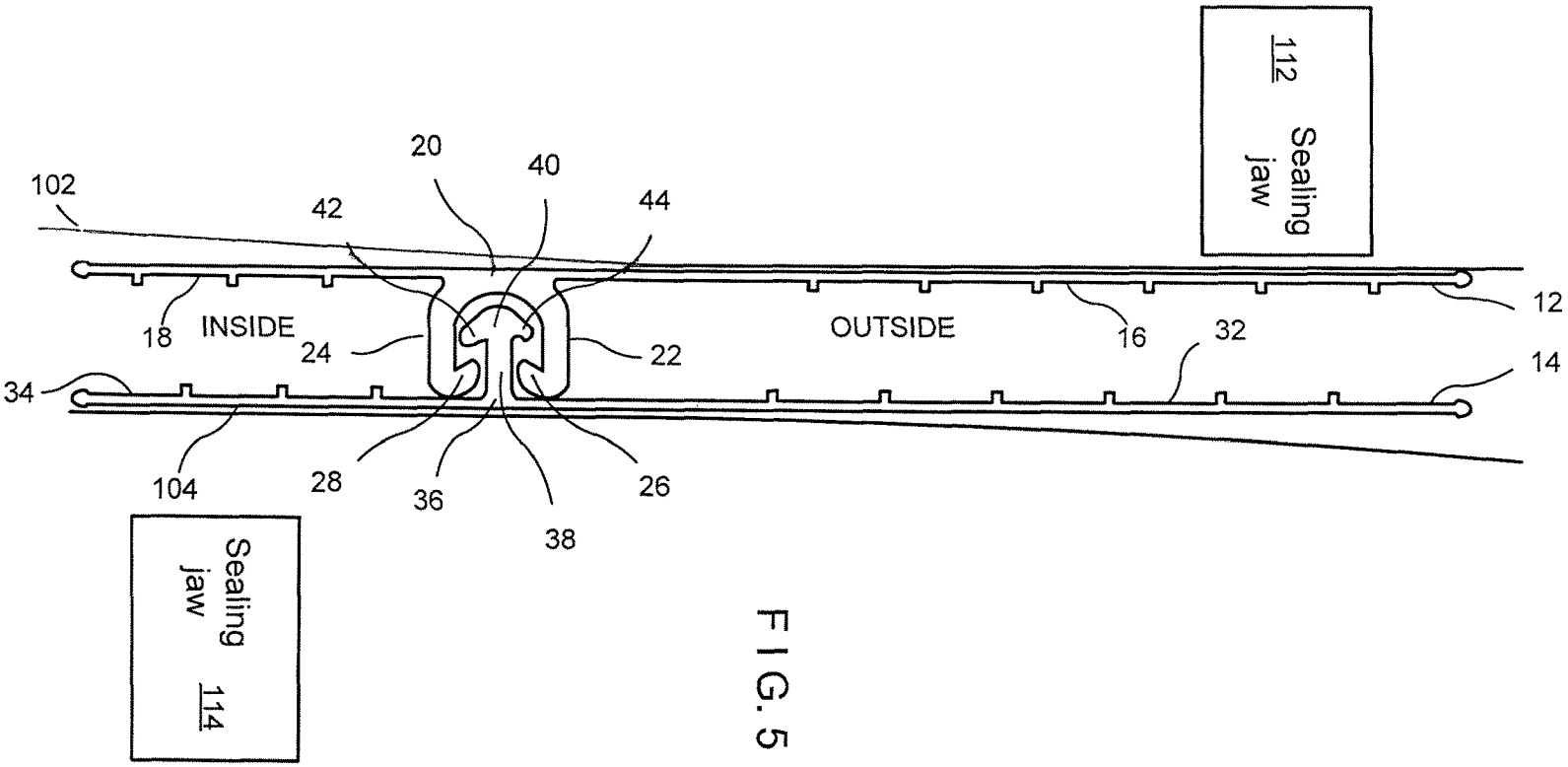
FIG. 5 illustrates a first configuration of sealing jaws in the first aspect of the present disclosure.

FIG. 5 illustrates a variation wherein sealing jaws 112, 114 seal the first exterior flange 16 to the first sidewall 102 and the second interior flange 34 to the second sidewall 104, but the first interior flange 18 and the second exterior flange 32 are free of sealing. FIG. 5 illustrates the seals as shown in FIG. 3.

Figure 6:
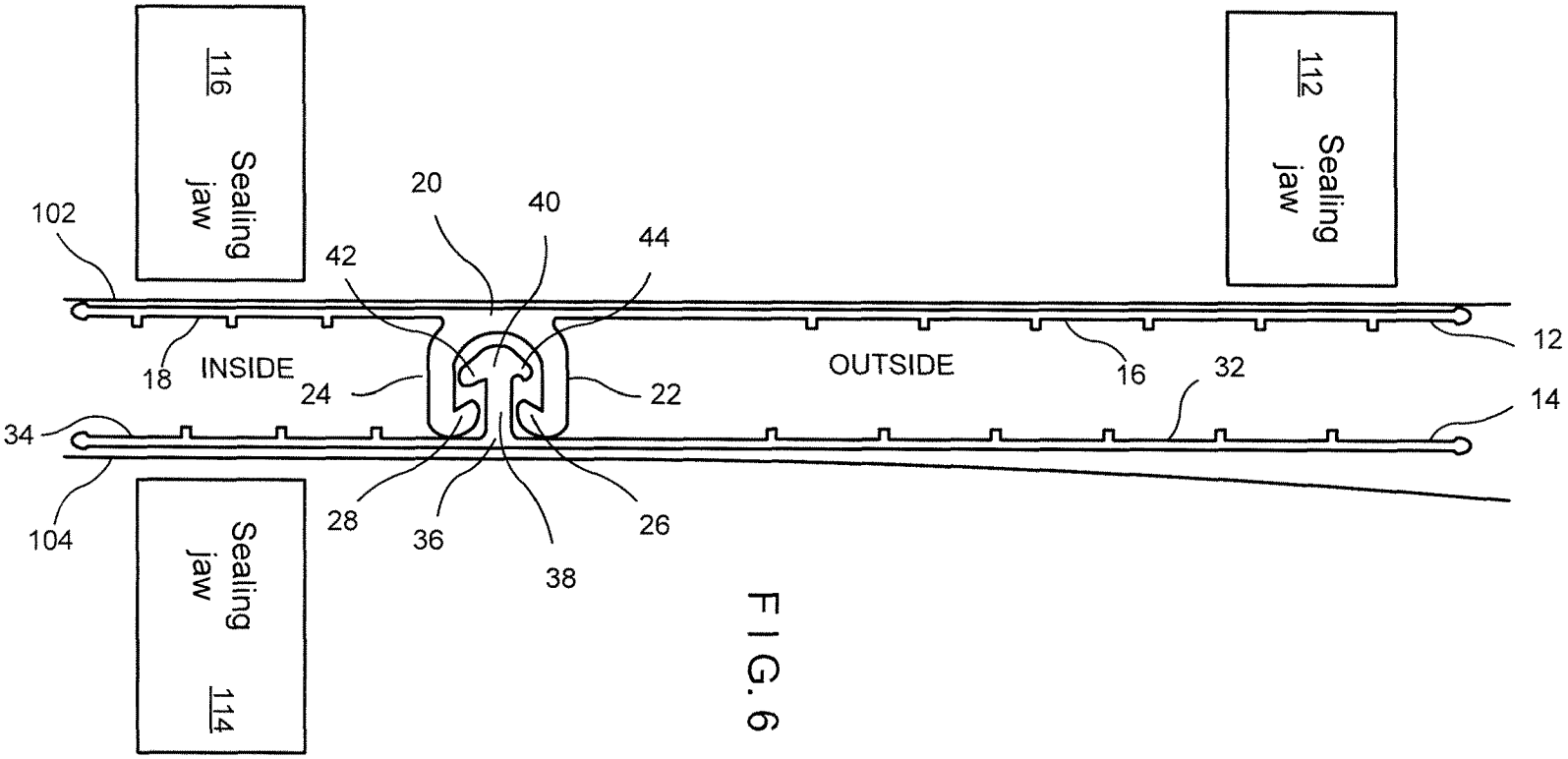
FIG. 6 illustrates a second configuration of sealing jaws in the first aspect of the present disclosure.
Figure 9:
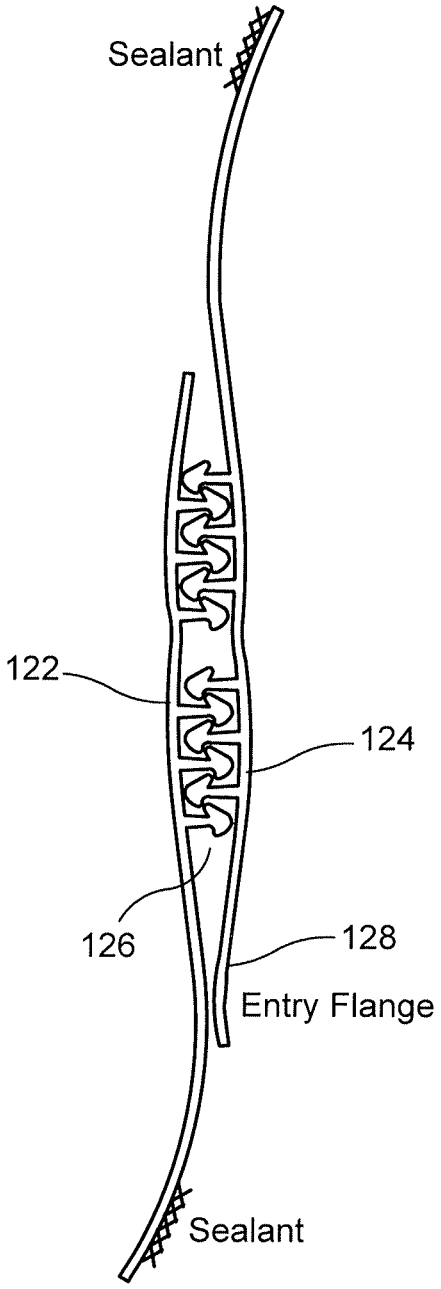
FIG. 9 illustrates a cross-sectional view of a third aspect of the present disclosure.

FIG. 6 adds an additional sealing jaw 116 to seal first interior flange 18 to the first sidewall 102. FIG. 6 illustrates the seals as shown in FIG. 4.

Figure 7:
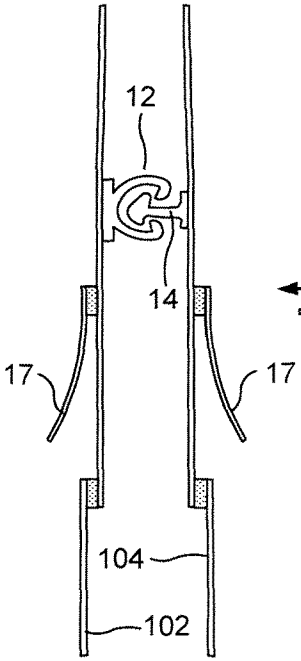
FIGS. 7 and 8 illustrate the open and closed configuration of the second aspect of the present disclosure.
Figure 8:
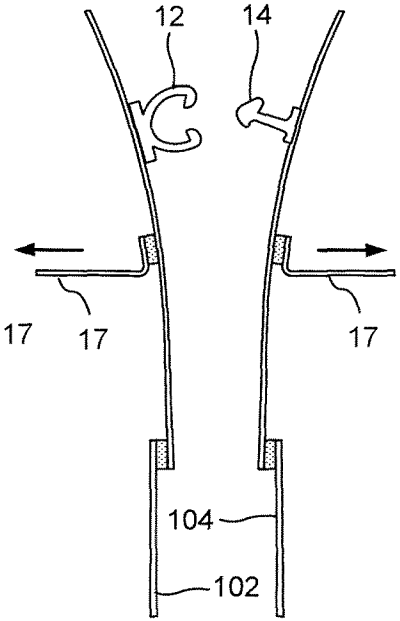

FIGS. 7 and 8 illustrate a second aspect of the present disclosure. A regular zipper 10 is placed in the bag 100 so that the internal side and external side are reversed (i.e., the male element is enlarged on the upper or consumer side). The zipper 10 needs to have high opening force through profile design or by sealing it so that a shearing effect is achieved. Two tabs 17 are provided below the interlocking elements in order to aid in opening the bag from below (i.e., the internal side). These can be made by making a fold of the film and sealing it or by having external tabs placed on the film. The folds need to be small so that it will be necessary to pinch them between two fingers to pull the film apart, thereby opening the zipper. Typically, a child would try to open this bag from the top. They will most likely not figure out how to use the film folds. Even if they do figure it out, they may not have the strength to pinch and pull the folds apart.

Utilizing the film as leverage for opening the zipper will enable various zipper designs to be used such as two flange, four flange, hinged, double zipper, or two zippers back to back (which would have the low opening force sides of the zippers face to face with the film fold in-between).

Figure 10:
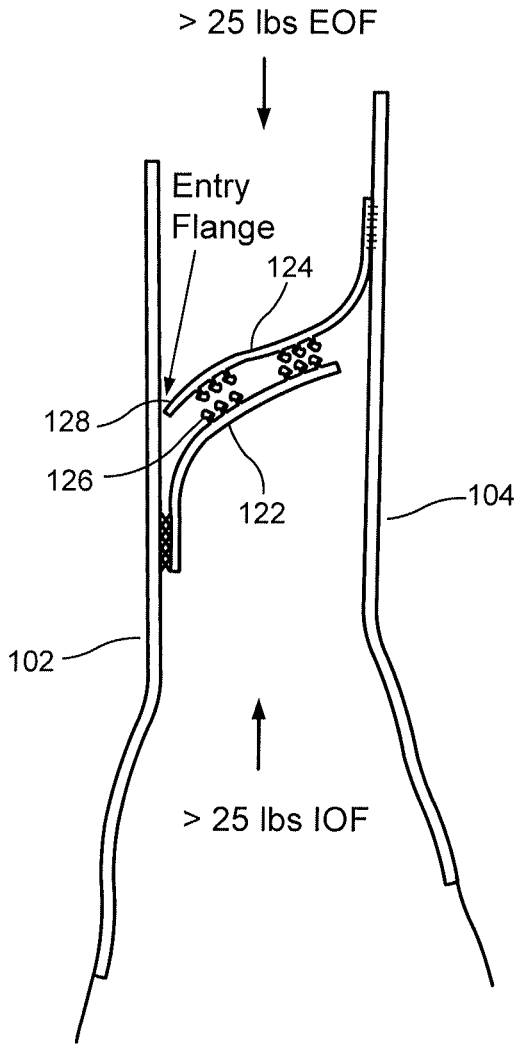
FIGS. 10, 11, 12 and 13 illustrate the opening sequence for a third aspect of the present disclosure.
Figure 11:
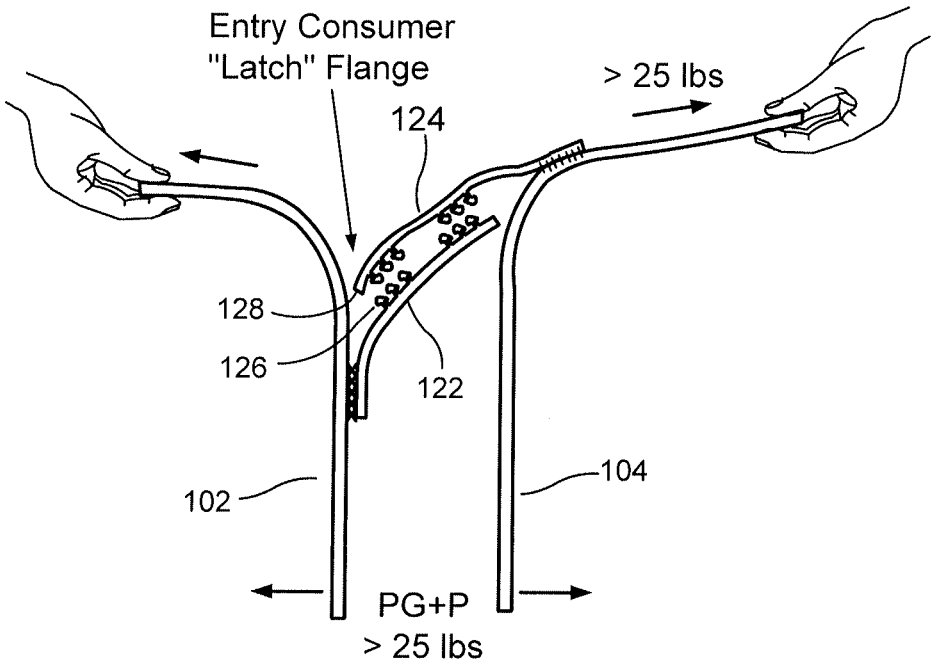
Figure 12:
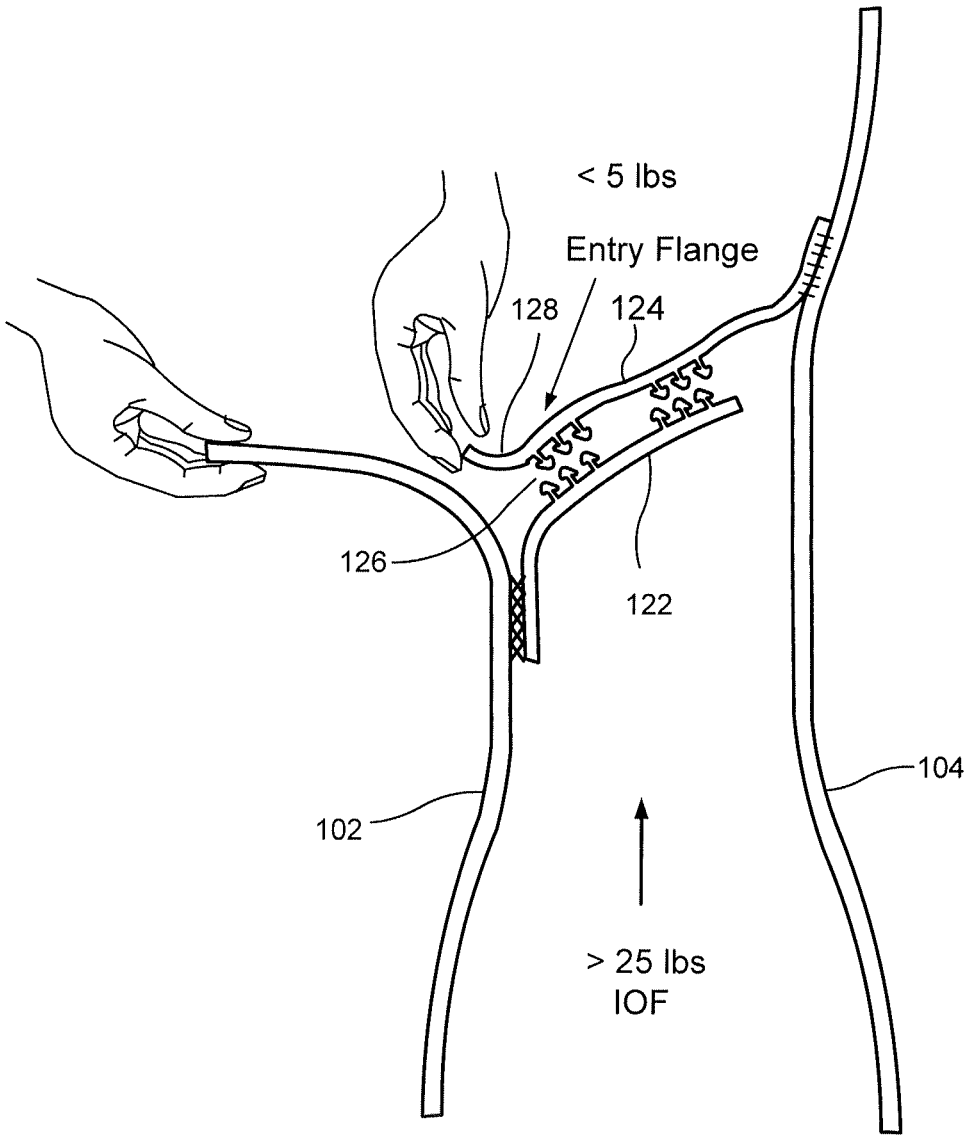
Figure 13:
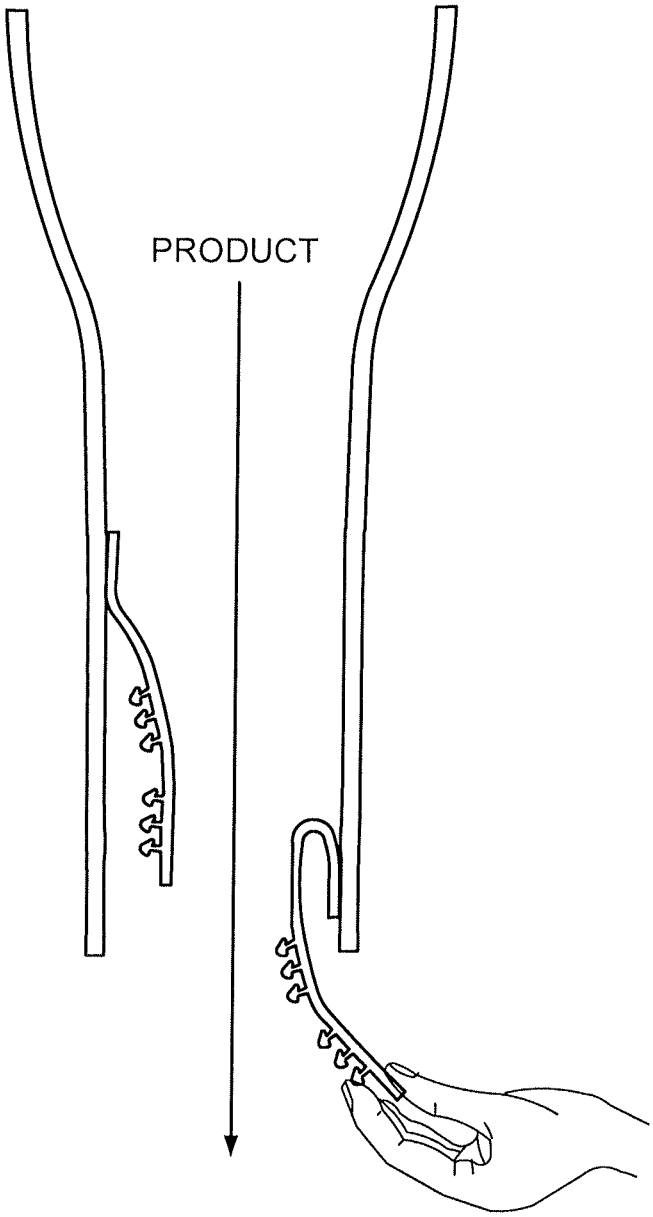
Figure 14:
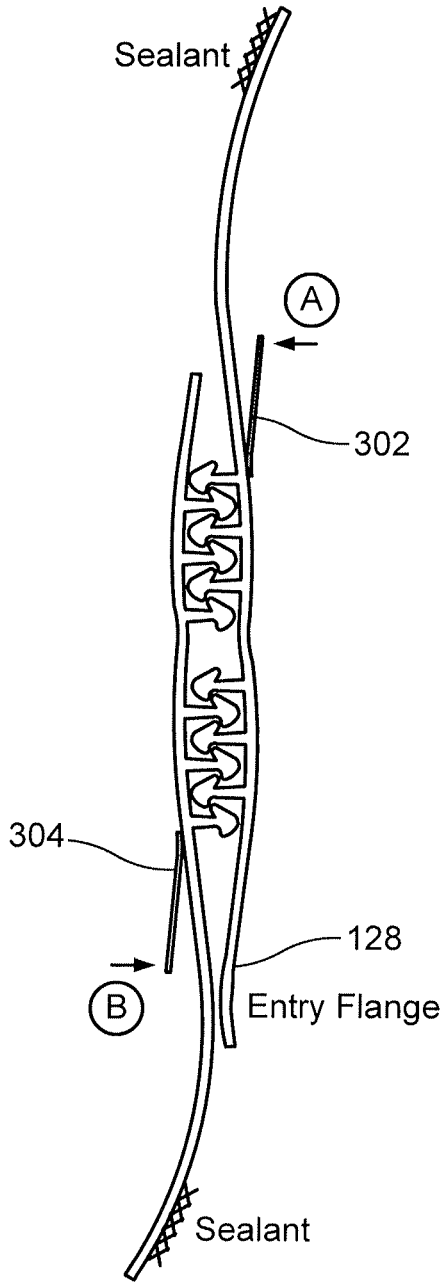
FIGS. 14, 15, 16 and 17 illustrate various methods of manufacture for a variation of the third aspect of the present disclosure.
Figure 15:
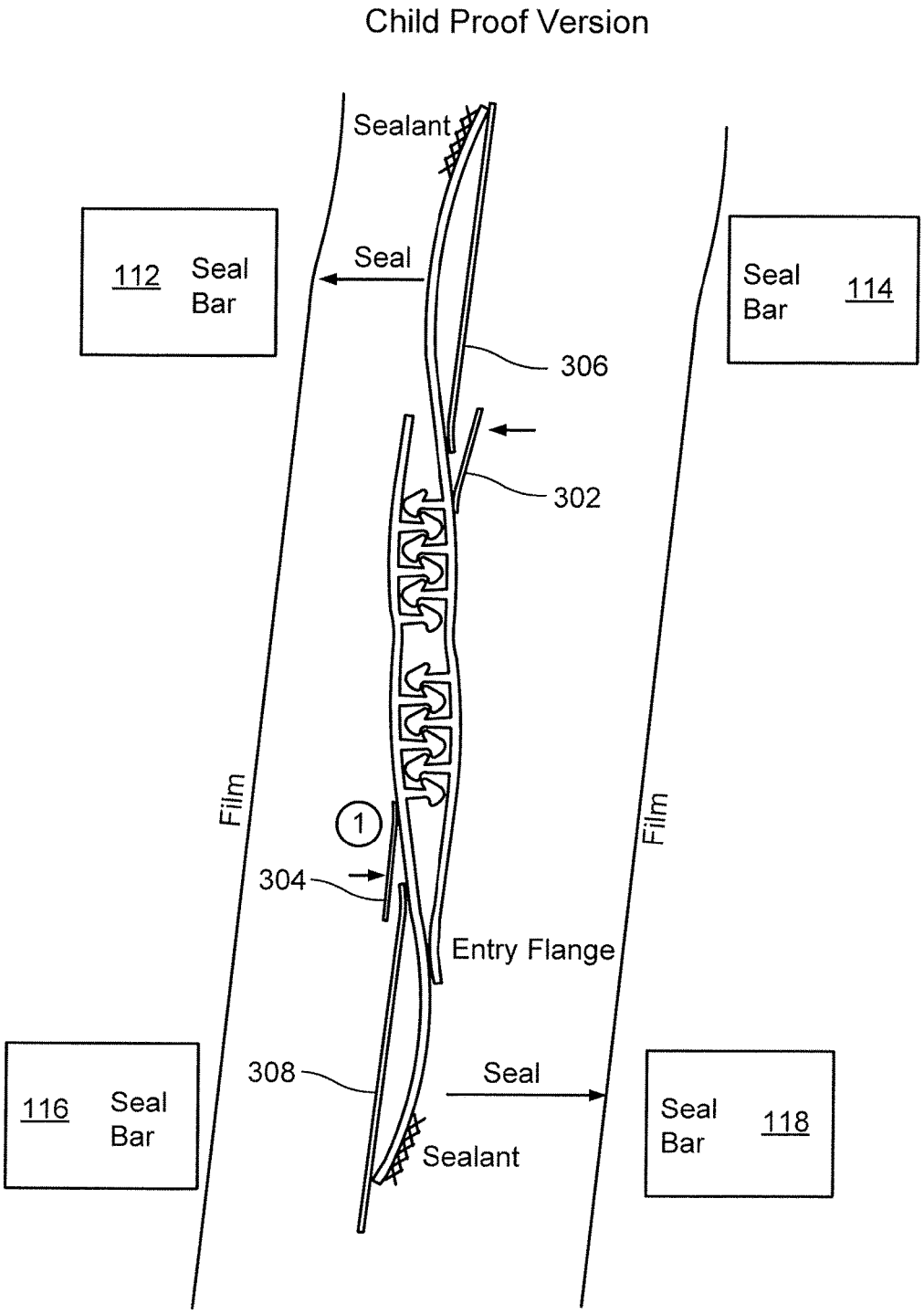
Figure 16:
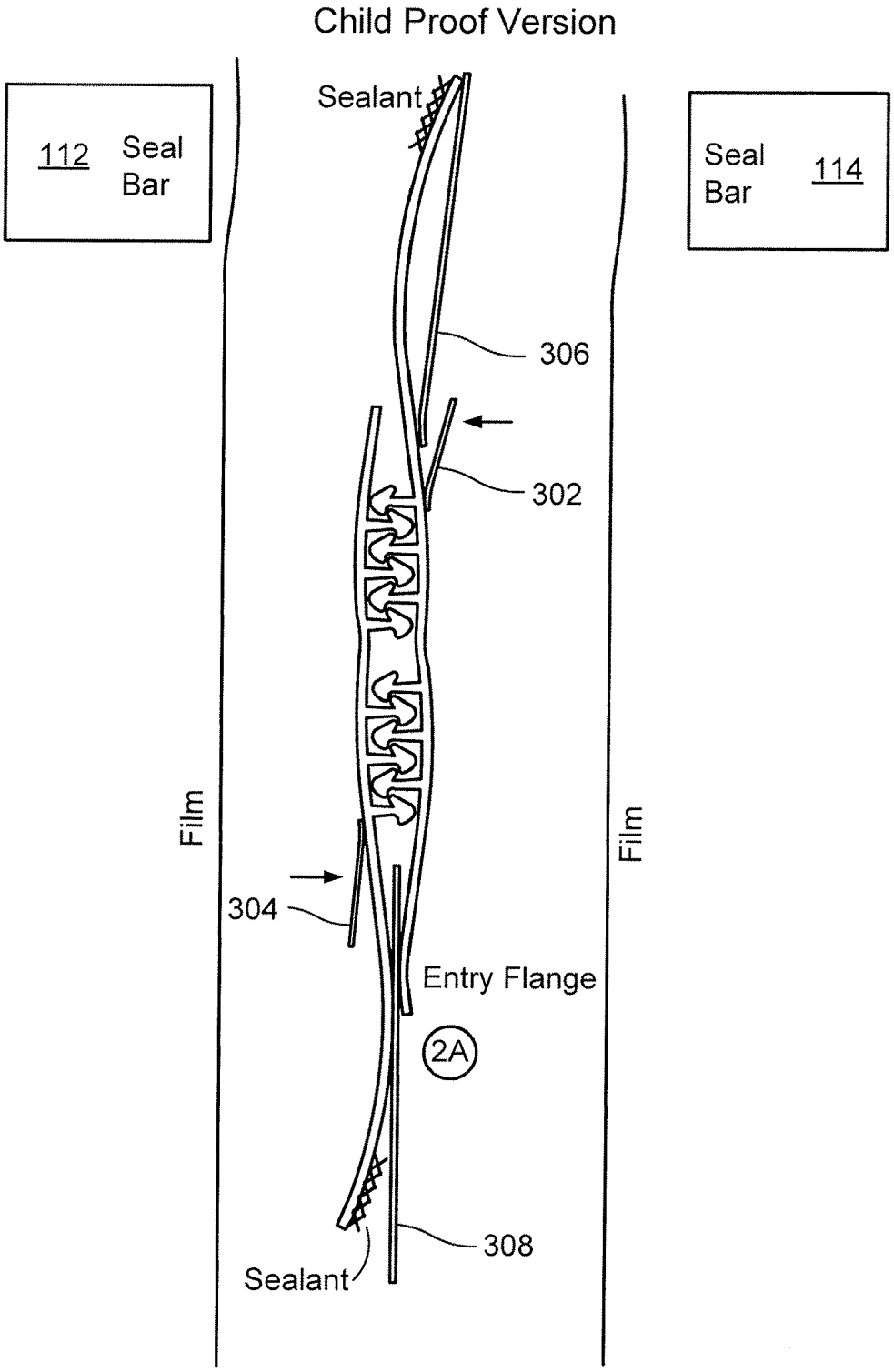
Figure 17:
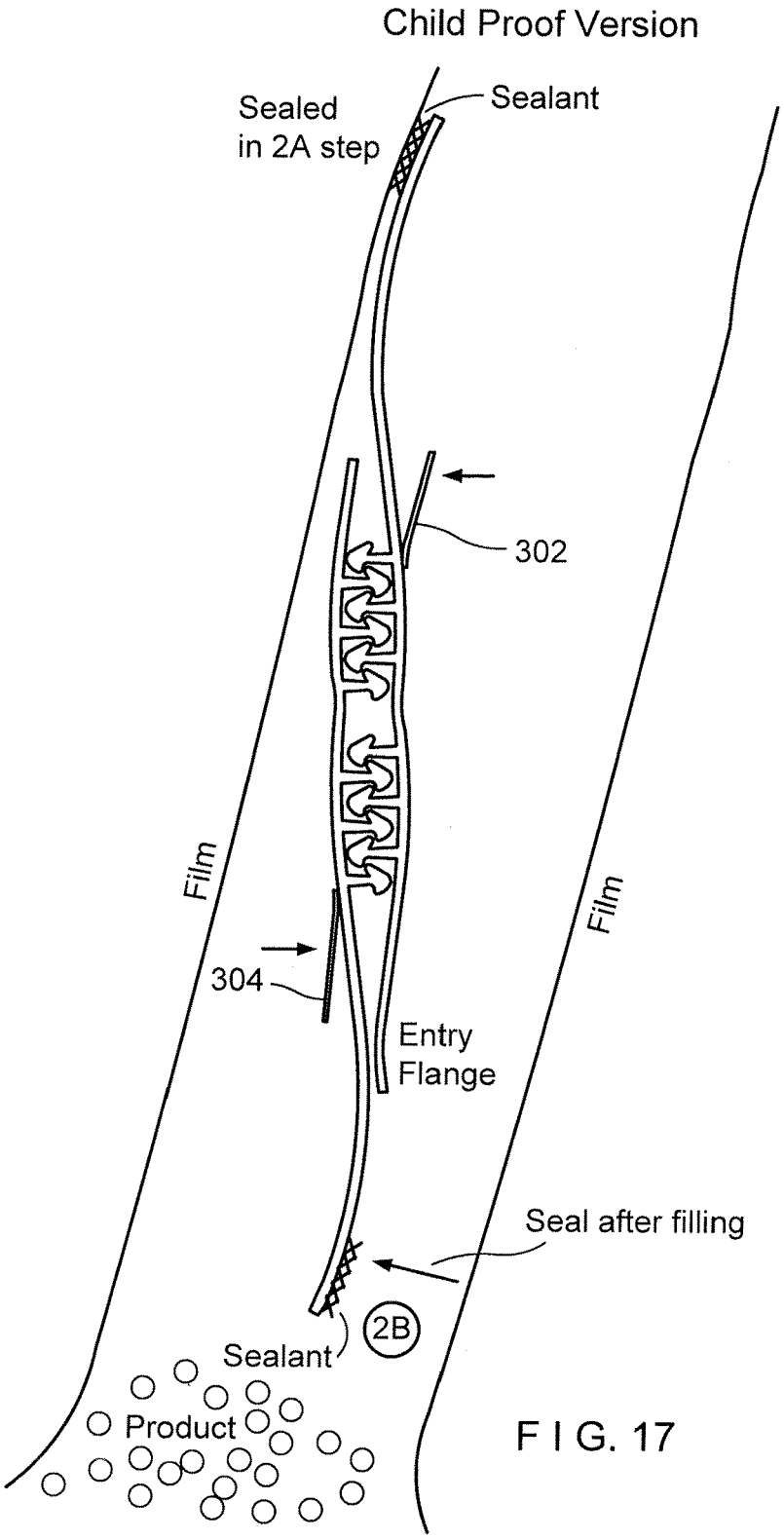

A third aspect of the disclosure is illustrated in FIGS. 9-13. FIG. 10 shows the cross-sectional of this third aspect. First sidewall 102 has a first flange 122 and second sidewall 104 has a second flange 124. First flange 122 is connected to first sidewall 102 and second flange 124 is connected to sidewall 104. First and second flanges 122, 124 are connected by a multiple-element variable-alignment zipper 126. An edge 128 of second flange 124 can be tucked, releasably engaged or hidden between the first sidewall 102 and the first flange 122. It would not be intuitive for a user, particularly a young user, to grasp the downwardly-pointing edge 128 of the second flange 124. However, if the consumer does not do this, this configuration will go into shear mode when attempted to be opened from either the consumer side of the package or the film or product side (pinch grip and pull). This configuration eliminates the reliance of opening forces and subsequent placement of film grip areas.

Figure 18:
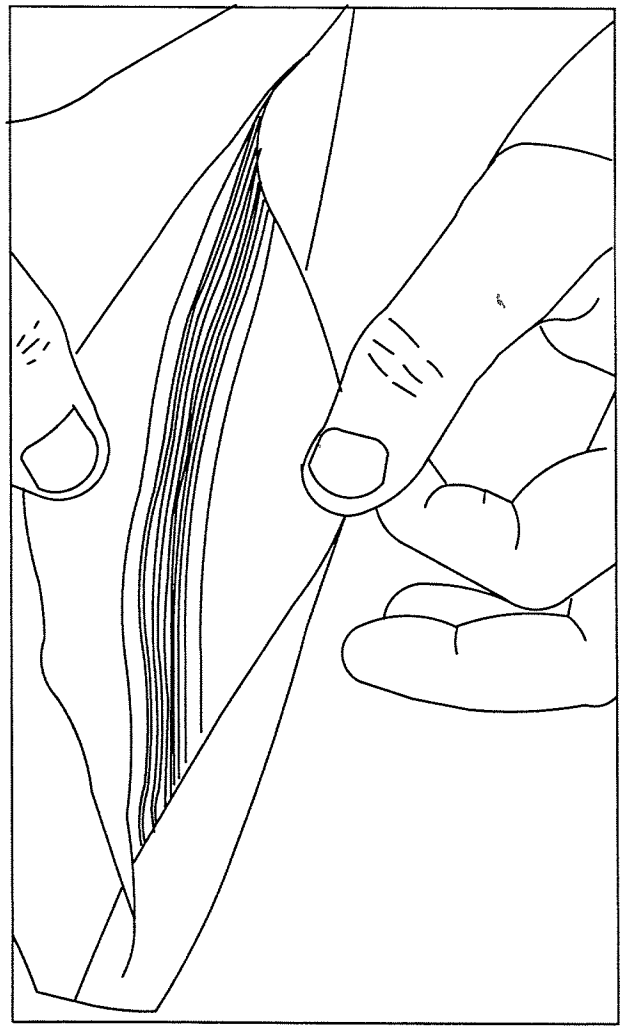
FIGS. 18 and 19 illustrate a further variation of the third aspect of the present disclosure.
Figure 19:
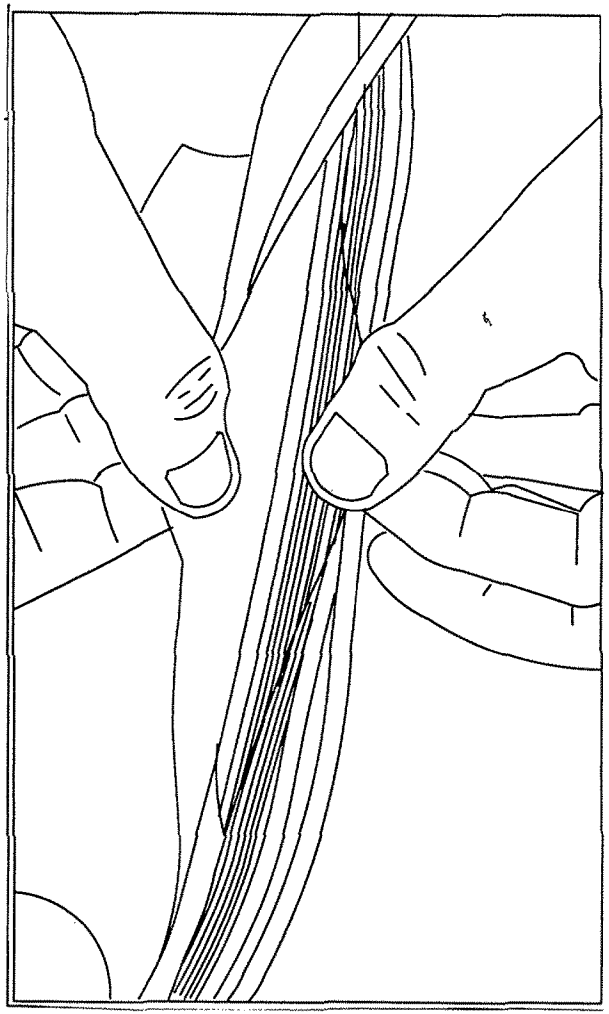

Further variations of the third aspect of this disclosure are illustrated in FIGS. 14-17. This configuration makes the zipper of the third aspect machine guidable. Virtually any profile configuration can be used. It can be used in virtually any horizontal form fill seal or premade application. Guide flanges 302, 304 are added to the respective zipper profiles. The zipper is guided by aligning the guides 306, 308 that fit between the guide flanges and their respective zipper flanges. Guides 306, 308 also serve to assure that the pairs of sealing bars 112, 114 and 116, 118 each seal only one sidewall to the respective profile. The resulting product is shown in FIGS. 18 and 19.

Figure 20A:
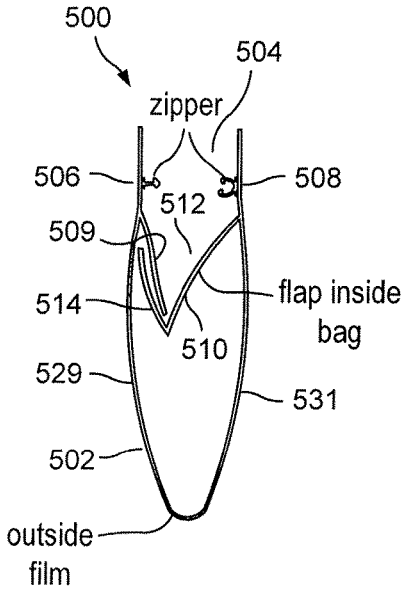
FIGS. 20A-20D illustrate the fourth aspect of the present disclosure.
Figure 20B:
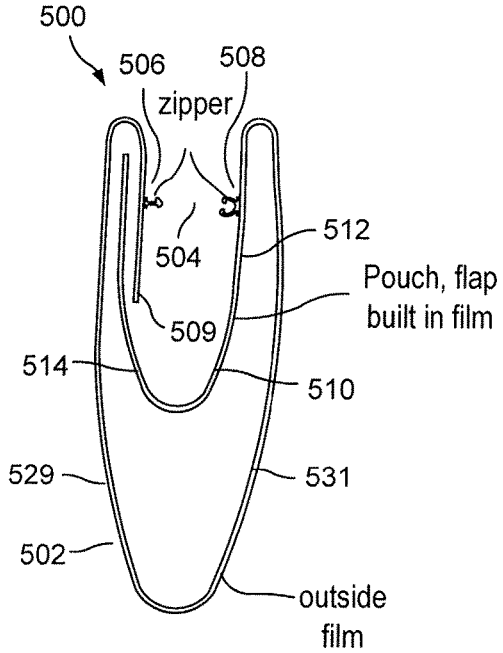
Figure 20C:
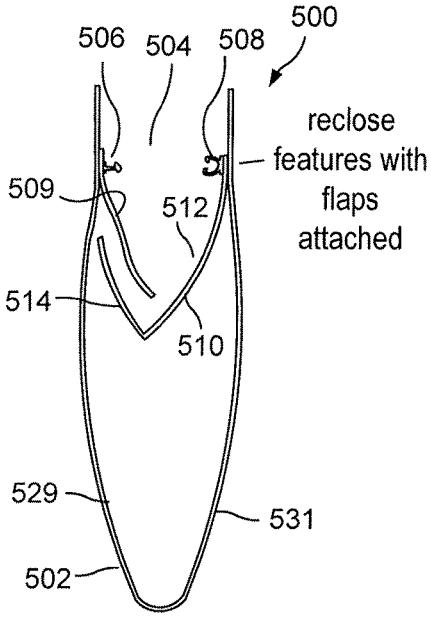
Figure 20D:
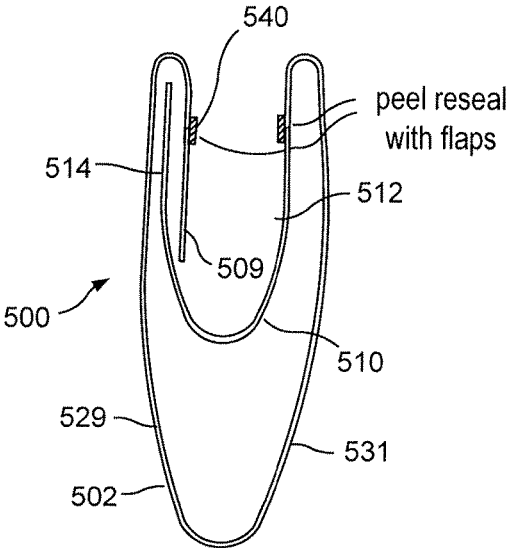

Various alternative embodiments of the fourth aspect of the disclosure are illustrated in FIGS. 20A-20D. This aspect includes bag flaps which are on the inside of the dispensing side of the bag or pouch 500. The flaps can be of separate material attached to the inside of the bag or integral with the bag material. The end of the one flap fits into the fold or point of attachment on the other flap. The illustrated aspect may call for materials to be put inside the dispensing portion of the bag formed by the outside film 502 which is folded to as to create first wall 529 and second wall 531, so as to create an "s" turn, thereby making the contents less accessible to children. The flap itself can be created by attaching materials to form a C-fold with a single flap in the middle of the C-fold. If the flap is tucked into the sides of the package, the flap will be tight and hard to get past without a high degree of dexterity. Furthermore, pulling the sides of the package apart to expose the flap will make it difficult to open and simultaneously stick one's hand inside. As illustrated in FIG. 20A, bag 500 is formed of walls 529 and 531 wherein first flap 509 is attached to first wall 529 immediately below the first zipper profile 506 of zipper 504. Similarly, the second flap 510 is formed with a V-shape and is attached to second wall 531 below the second profile 508 of zipper 504. The second flap 510 includes a proximal portion 512 which is attached to the second wall 531 and a distal portion 514 which is tucked under first flap 509. In FIG. 20B, first flap 509 is formed by folding down the first wall 529. First zipper profile 506 of the zipper 504 is attached to the first flap 509. The right wall 531 is folded in an S-configuration so as to create proximate portion 512 of second flap 510 and distal portion 514 of second flap 510. Second zipper profile 508 is attached to proximal portion 512 of second flap 510. Distal portion 514 is tucked under first flap 509. FIG. 20C is similar to FIG. 20A except that first flap 509 is formed as an integral flange with first zipper profile 506 and second flap 510 is formed as an integral flange with second zipper profile 508. FIG. 20D is similar to FIG. 20B except that the zipper is replaced with a peel seal 540, shown in a separated configuration.

This results in a package which would be self-closing despite not being locked. Creating a specific path to follow to get into the package provides advantages over the prior art. Taken from the sandwich bag, the flap can be created in a variety of configurations.

In all of these aspects of the disclosure, it is envisioned that the zipper may be installed in a machine or transverse direction during manufacture.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A container or bag, including:

a first wall and a second wall, the first wall and the second wall being joined together so as to form a storage volume therebetween and a mouth;

a zipper attached to the first wall and second wall, thereby making the mouth reclosable, and defining an inside of the container or bag oriented toward the storage volume and an outside of the container or bag oriented toward the mouth, the zipper including:

a first profile including a first interior flange, a first interlocking element and a first exterior flange; and a second profile including a second interior flange, a second interlocking element and a second exterior flange, the second exterior flange having sufficient length to include a manually grippable portion;

wherein the first interior flange is attached to the first wall on an inside of the container or bag, the second interior flange is attached to the second wall on an inside of the container or bag; and wherein the second wall extends beyond the second exterior flange, the second exterior flange being unattached to the second bag wall, whereby opening forces applied to the outside of the second wall of the package or bag are transmitted to the second interior flange and to the interior of the first and second interlocking elements whereby increased interior opening forces are encountered, thereby resisting access to the interior of the bag, and whereby opening forces applied to the manually grippable portion of the second exterior flange are transmitted to the first and second interlocking elements whereby decreased exterior opening forces are encountered.

2. The container or bag of claim 1 wherein the first wall and the second wall are formed of polymeric material.

3. The container or bag of claim 1 wherein the zipper is formed of polymeric material.

4. The container or bag of claim 3 wherein the first interlocking element is a first of a male and a female element and the second interlocking element is a second of a male and a female element.

5. The container or bag of claim 4 wherein male element includes a shaft element and an arrowhead element, wherein the arrowhead includes a first side oriented toward the outside and a second side oriented toward the inside, wherein the second side is more enlarged than the first side, thereby causing inside opening threes to be greater than outside opening forces.

6. The container or bag of claim 5 in a child-resistant application.

7. A container or bag, including:

a first wall and a second wall, the first wall and the second wall being joined together so as to form a storage volume therebetween and a mouth;

a zipper attached to the first wall and second wall, thereby making the mouth reclosable, and defining an inside of the container or bag oriented toward the storage volume and an outside of the container or bag oriented toward the mouth, the zipper including:

a first profile including a first interior flange, a first interlocking element and a first exterior flange; and a second profile including a second interior flange, a second interlocking element and a second exterior flange, the second exterior flange having sufficient length to include a manually grippable portion;

wherein the first exterior flange is attached to the first wall on an outside of the container or bag and the second interior flange is attached to the second wall on an inside of the container or bag; and wherein the second wall extends beyond the second exterior flange, the second exterior flange being unattached to the second bag wall, whereby opening forces applied to the outside of the second wall of the package or bag are transmitted to the second interior flange and to the interior of the first and second interlocking elements whereby increased interior opening forces are encountered, thereby resisting access to the interior of the bag, and whereby opening forces applied to the manually grippable portion of the second exterior flange are transmitted to the first and second interlocking element whereby decreased opening forces are encountered.

8. The container or bag of claim 7 wherein the first interior flange is attached to the first wall on an inside of the container or bag.

9. The container or bag of claim 7 wherein the first wall, the second wall and the zipper are formed of polymeric material.

10. The container or bag of claim 9 wherein the first interlocking element is a first of a male and a female element and the second interlocking element is a second of a male and a female element.

11. The container or bag of claim 9 wherein male element includes a shaft element and an arrowhead element, wherein the arrowhead includes a first side oriented toward the outside of the container or bag and a second side oriented toward the inside, wherein the second side is more enlarged than the first side, thereby causing inside opening forces to be greater than outside opening forces.

12. The container or bag of claim 11 in a child-resistant application.

* * * * *